US007828183B2

(12) United States Patent
Furutsu

(10) Patent No.: US 7,828,183 B2
(45) Date of Patent: Nov. 9, 2010

(54) DEVICE FOR ATTACHING FASTENERS

(75) Inventor: Akira Furutsu, Tokyo (JP)

(73) Assignee: Kabushiki Kaisya Toska, Tokyo (JP)

( * ) Notice: Subject to any disclaimer, the term of this patent is extended or adjusted under 35 U.S.C. 154(b) by 122 days.

(21) Appl. No.: 11/977,407

(22) Filed: Oct. 24, 2007

(65) Prior Publication Data

US 2009/0039133 A1 Feb. 12, 2009

(30) Foreign Application Priority Data

Aug. 10, 2007 (JP) ..... 2007-209620

(51) Int. Cl.
*B25C 5/11* (2006.01)

(52) U.S. Cl. ..... 227/67; 227/140; 227/109

(58) Field of Classification Search ..... 227/67, 227/68, 135, 136, 140
See application file for complete search history.

(56) References Cited

U.S. PATENT DOCUMENTS

| | | | | |
|---|---|---|---|---|
| 3,815,798 | A * | 6/1974 | Lavitch et al. | 223/102 |
| 3,901,428 | A * | 8/1975 | Grass | 227/67 |
| 4,492,330 | A * | 1/1985 | Furutsu | 227/67 |
| 4,593,844 | A * | 6/1986 | Bone | 227/67 |
| 4,651,913 | A * | 3/1987 | Bone | 227/67 |
| 4,664,306 | A * | 5/1987 | Levy | 227/67 |
| 4,838,469 | A * | 6/1989 | Strausburg | 227/67 |
| 5,090,490 | A * | 2/1992 | Block | 173/171 |
| 5,398,859 | A * | 3/1995 | Lee | 227/67 |
| 5,482,196 | A * | 1/1996 | Doyel | 227/67 |
| 5,772,073 | A * | 6/1998 | Deschenes | 221/197 |
| 5,878,935 | A * | 3/1999 | Furutsu | 227/67 |
| 5,933,925 | A * | 8/1999 | Anscher et al. | 24/163 R |
| 6,655,571 | B2 * | 12/2003 | Ueno | 227/67 |
| 6,739,491 | B2 * | 5/2004 | Hirai | 227/67 |
| 2002/0121538 | A1 * | 9/2002 | Cooper et al. | 227/67 |
| 2003/0218043 | A1 * | 11/2003 | Cooper et al. | 227/67 |
| 2004/0056064 | A1 * | 3/2004 | Ueno | 227/67 |
| 2006/0113349 | A1 * | 6/2006 | Ueno | 227/67 |

FOREIGN PATENT DOCUMENTS

| | | |
|---|---|---|
| JP | 2001-253419 A | 9/2001 |
| JP | 3112848 | 7/2005 |
| JP | 2007-223640 A | 9/2007 |

* cited by examiner

*Primary Examiner*—Rinaldi I. Rada
*Assistant Examiner*—Lindsay Low
(74) *Attorney, Agent, or Firm*—Holtz, Holtz, Goodman & Chick, PC

(57) ABSTRACT

A device for attaching fasteners has a casing having a grip, a lever supported by the casing rotatably about its upper end and urged forward, a link arm actuated by the rotation of the lever, a piston engaged slidably by the upper end of the link arm, a driving rod slidable with the piston, a hollow needle situated at the leading end of the driving rod and having a slit and a guide formed behind the hollow needle for fitting an assembly of plastic fasteners. A guide attachment which can be changed to another is removably held below the assembly fitting guide for guiding a connecting bar in the assembly in the direction of its ejection.

7 Claims, 11 Drawing Sheets

DEVICE FOR ATTACHING FASTENERS

BACKGROUND OF THE INVENTION

1. Field of the Invention

The present invention relates to an improvement in the device for attaching fasteners and more particularly the device which can attach plastic fasteners continuously in one action to pieces of merchandise, such as clothes, so that each fastener may hold a tag hanging from one of those pieces of merchandise to show e.g. its price and quality.

2. Description of the Related Art

Known fasteners of the type as described are shown in FIG. 14. Before they are attached, the fasteners 1 form an assembly A in which they are connected to a connecting bar 2 by holding pins 3 in an equally spaced and juxtaposed relation to one another. Each fastener 1 has a filamentary portion 4, a retaining paddle 5 defining its top and a lateral pin 6 extending at right angles to its filamentary portion 4 and defining its bottom, and is driven through and attached to an article, such as clothes, to hang a tag therefrom.

Various types of devices are known for attaching fasteners and each device generally has a guide extending vertically therethrough to support a fastener assembly as described above, a piston slidable by a lever and a driving rod carried at the front end of the piston for forcing the lateral pin 6 of each fastener into a hollow needle having a slit, whereupon the lateral pin 6 is severed from the holding pin 3, so that the fastener 1 may be attached to an article. As the hollow needle is passed through a hole in a tag and forced through the article, the lateral pin 6 leaves the hollow needle to stay on the opposite side of the article, while the filamentary portion 4 leaves the hollow needle through its slit.

The device also has a mechanism for feeding the assembly A intermittently by a distance equal to the pitch between every two adjoining fasteners 1, while the connecting bar 2 from which all the fasteners 1 have been separated is moved down and ejected.

As the feeding mechanism has a pawl which is rotatable to engage a holding pin 3 on the assembly A and move it, the combination of a plurality of arms, etc. forms a complicated structure having a large number of parts and involving a high stroke load.

When the connecting bar 2 is moved down to be ejected, it arrives in front of the fingers of a person holding the grip and lever to operate the device and is likely to interfere with its operation, or the holding pins 3 remaining on the connecting bar are likely to hurt his finger or fingers.

Therefore, there has recently been proposed a mechanism for moving the connecting bar 2 backward through the device to eject it from the back of the device instead of moving it down.

When the hollow needle has at its rear end a cutter for separating each fastener from the assembly, a damaged cutter requires the exchange of the whole hollow needle, even though it may be very uneconomical.

However, it may sometimes be the case that the connecting bar is so short as to stay within the device without being ejected from its back.

The following is a list of literature showing related art of which the applicant is aware:

(1) Japanese Patent Publication JP-A-2001-253419;

(2) Japanese Utility Model Registration 3,112,848;

(3) Japanese Patent Application 2006-46574.

SUMMARY OF THE INVENTION

Problems which the invention is aimed at solving arise from the facts that when the ejection of the connecting bar from which the fasteners have been separated is performed by its backward movement through the device, its leading end is directed toward the operator of the device and may hurt him in e.g. the face, and that it is difficult to realize any device that is suitable for any fastener assembly length, since any assembly that is too small in length may have its connecting bar stay in the device and require the casing of the device to be disassembled for the removal of the connecting bar.

Other problems that the invention is aimed at solving arise from the facts that the known mechanism for feeding a fastener assembly is complicated in construction with a large number of parts, therefore fails easily and is expensive, and involves a high stroke load, and that a damaged cutter requires the exchange of the whole hollow needle, while the positioning of a removable cutter and its removal are troublesome.

According to one aspect of the invention, the problems as stated above are solved by a device for attaching fasteners which comprises a casing having a grip, a lever supported by the casing rotatably about its upper end and urged forward, a link arm actuated by the rotation of the lever, a piston engaged slidably by the upper end of the link arm, a driving rod slidable with the piston, a hollow needle situated at the leading end of the driving rod and having a slit and a guide formed behind the hollow needle for fitting an assembly of plastic fasteners, wherein a guide attachment which can be changed to another is removably held below the assembly fitting guide for guiding a connecting bar in the assembly in the direction of its ejection, wherein the casing has a guide groove formed on one side thereof for guiding the ejection of the connecting bar of the assembly, the guide attachment has a curved surface directed toward the ejection guide groove and the casing has a hole connected with the ejection guide groove, while the lever also has a hole, so that the connecting bar may be passed through those holes, wherein the ejection guide groove is gradually reduced in depth and width to allow the ejection of the connecting bar so that its leading end may move away from the casing, wherein one of the guide attachments has a hole formed at its bottom to allow the downward ejection of the connecting bar along the assembly fitting guide, and wherein the hole formed in the lever for the insertion of a part of the attachment has a rounded inner surface brought into sliding contact with the inserted outer surface of the attachment to prevent any clearance from occurring therebetween upon the rotation of the lever.

According to another aspect of the invention, there is provided a device for attaching fasteners which comprises a casing having a grip, a lever supported by the casing rotatably about its upper end and urged forward, a link arm actuated by the rotation of the lever, a piston engaged slidably by the upper end of the link arm, a driving rod slidable with the piston, a hollow needle situated at the leading end of the driving rod and having a slit, a guide formed behind the hollow needle for fitting an assembly of plastic fasteners and a mechanism associated with the assembly fitting guide and having a pawl for feeding the assembly, wherein the feeding mechanism has a member rotatable by the piston pressed against its rear end, the pawl being formed at the front end of the rotatable member as an integral part thereof, wherein the rotatable member has an arcuate rear end surface held in sliding engagement with an arcuate groove formed in the front end surface of the piston and is connected to the casing by a coil spring urging it into its initial position, wherein the rotatable member has a substantially oval slot formed near its rear end, while a pin protruding from a supporting member at its front end engages in the slot to control the rotation of the rotatable member, and wherein the supporting member is positioned by an inner rib in the casing, the link arm has an angular or chevron protrusion formed on its front end surface and having an edge surface held in sliding contact with the inner rib, the angular protrusion being formed near a pin about which the link arm is supported rotatably, so that a supporting point defined in the area of their sliding contact may realize an improved stroke force.

According to further aspects of the invention, the device further includes a removable needle cap which is put on the hollow needle when it is out of use, the needle cap having a scrape pawl formed at its front end for scraping off any remaining connecting bar, wherein the device further includes a removable cutter for severing each individual fastener from the assembly along the assembly fitting guide, the cutter having a substantially L-shaped bent lower end positioned by the curved surface portion of the guide attachment pressed against it, wherein the scrape pawl at the front end of the needle cap has a cutaway portion which is engageable with the L-shaped lower end of the cutter for its removal, wherein the casing has a filament passage guide slit formed to connect the assembly fitting guide and the slit of the hollow needle and having an undulating portion to allow the paddles of the fasteners to pass therethrough, wherein the ejection guide groove has an auxiliary taper formed on its inner bottom wall surface and having an angle or chevron section, and wherein the guide attachment has elastic clips formed as integral parts thereof to set it in position, at least the clip which is positioned outside the casing terminating in an engaging pawl to produce a retaining action to hold the attachment against the casing.

Since the device for attaching fasteners according to the invention is constructed as described above, the connecting bar remaining after the separation of the fasteners from their assembly and carrying only their holding pins is progressively ejected backwardly of the casing and in a way gradually moving away therefrom without causing any fear of hurting the operator of the device or interfering with its operation and the device is suitable for use with any fastener assembly irrespective of its length. However, the use of a different attachment makes it possible to eject such a connecting bar downward without requiring the aid of any known attachment changing mechanism, and therefore without having any such trouble as might arise from the change of attachments by such a mechanism. Even if a fastener assembly may be small in length, its connecting bar can be removed from the device. The removable cutter is easy to place in position and remove.

Since the assembly feeding mechanism requires only a rotatable member having a feeding pawl at its front end and rotatable by a piston, while the range of its rotation is controlled by a pin on a supporting member, it has only a small number of parts, is less liable to trouble, is less expensive and realizes a lower stroke load and thereby a lower degree of fatigue in operation. This enables a reduction in size and weight of the device as a whole.

Even if the fastener assembly may have blocked the device or have been consumed unexpectedly, or may have too large or small a pitch between every two adjoining individual fasteners, its connecting bar can be removed easily by the scrape pawl at the front end of the needle cap.

DESCRIPTION OF THE PREFERRED EMBODIMENTS

The best mode of carrying out the invention is shown as a preferred embodiment thereof in the accompanying drawings.

Figure 1A:
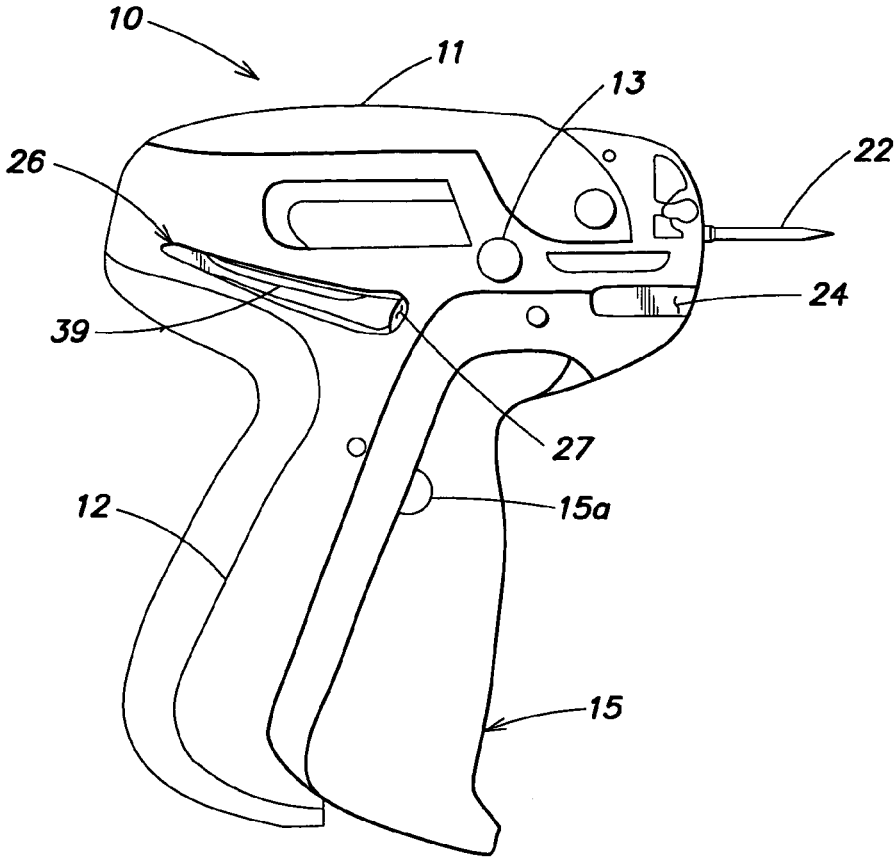
FIG. 1A is a left side elevational view of a device for attaching fasteners which embodies the invention.
Figure 1B:
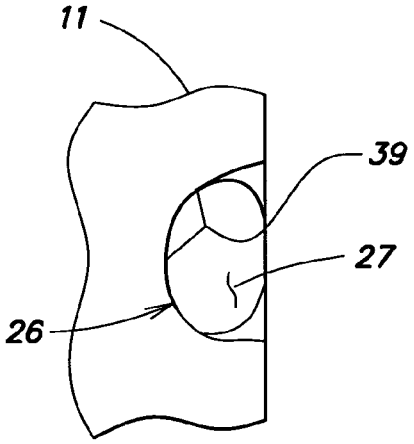
FIG. 1B is an enlarged sectional view of a part of FIG. 1A.
Figure 1C:
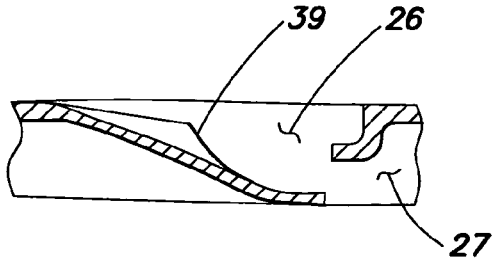
FIG. 1C is a longitudinal view of the part shown in FIG. 1B.
Figure 2:
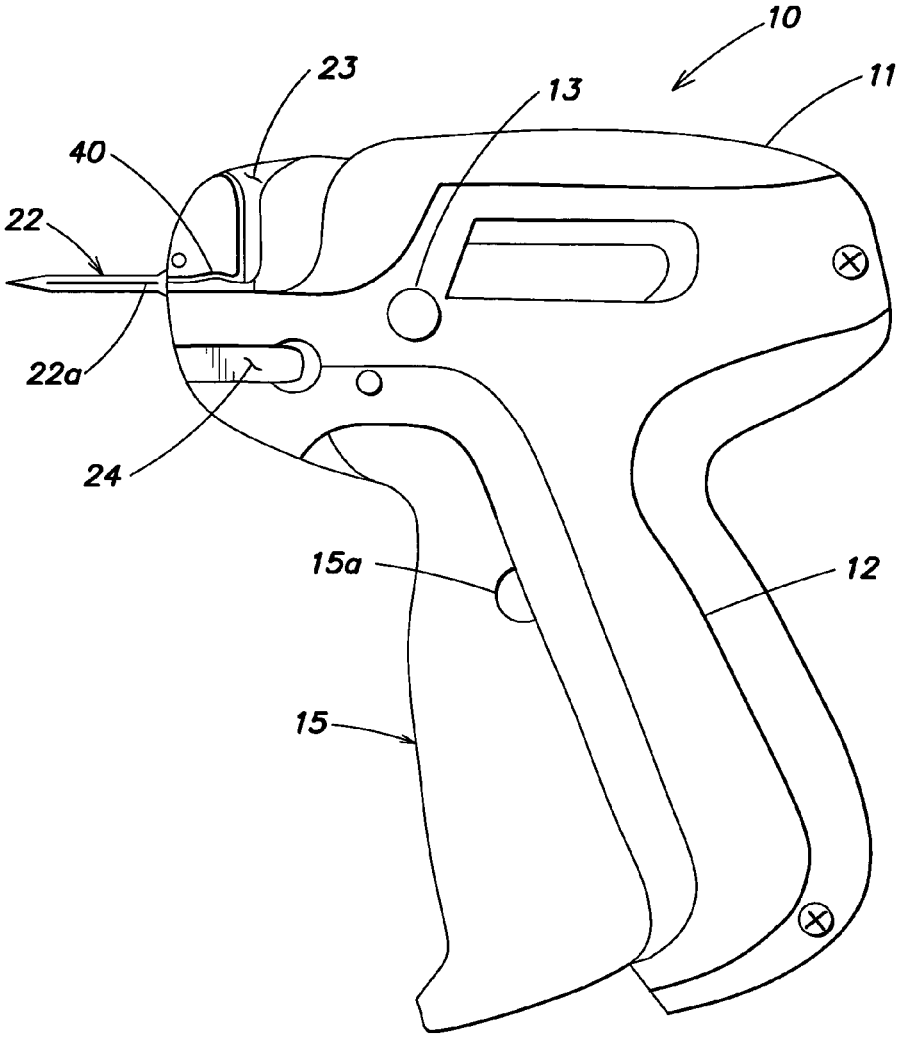
FIG. 2 is a right side elevational view of the device.
Figure 3:
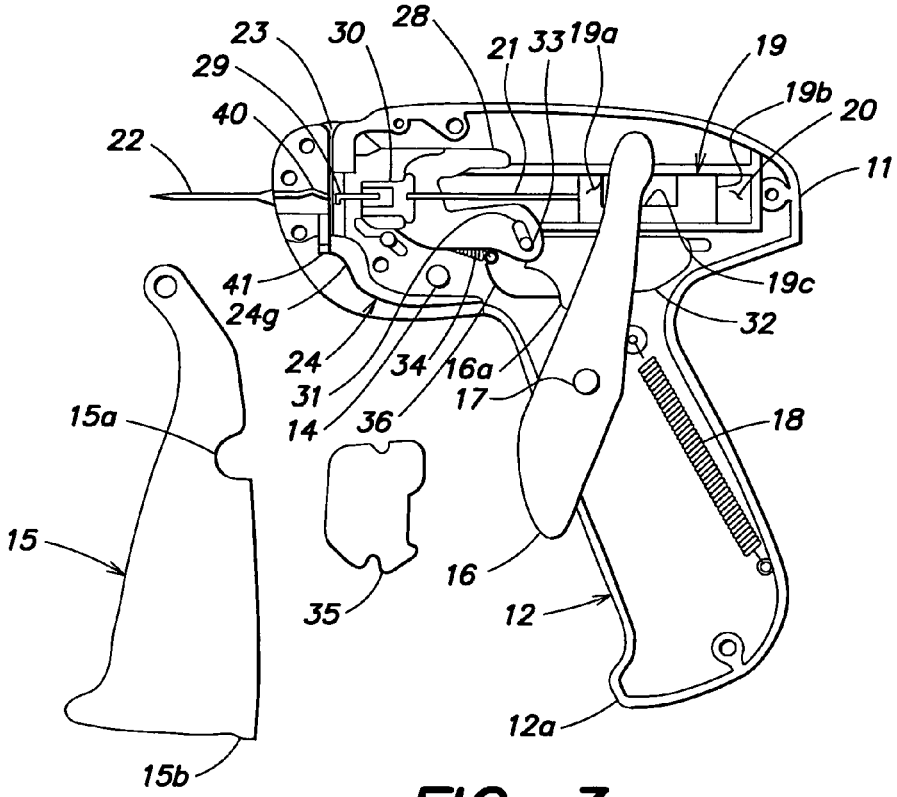
FIG. 3 is an exploded side elevational view showing its construction.
Figure 4:
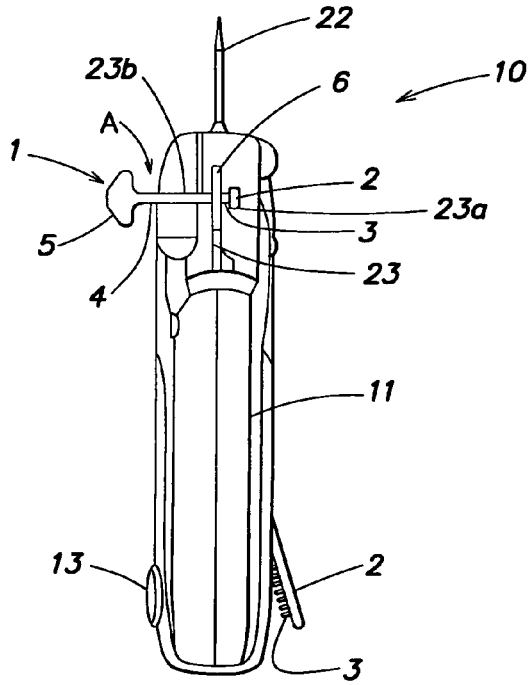
FIG. 4 is a top plan view of the device.
Figure 5:
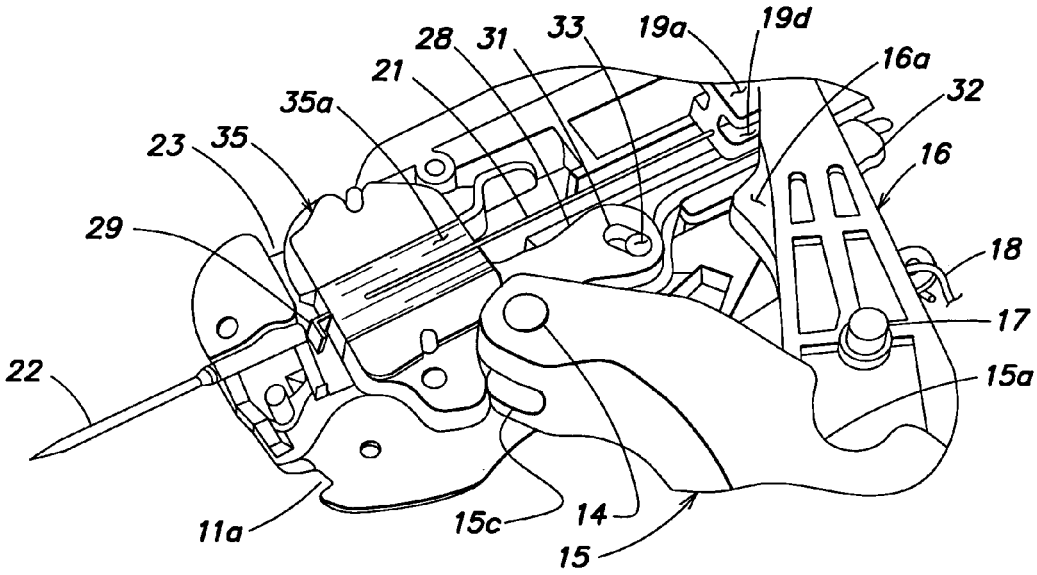
FIG. 5 is an enlarged perspective view showing a part of its construction.
Figure 6:
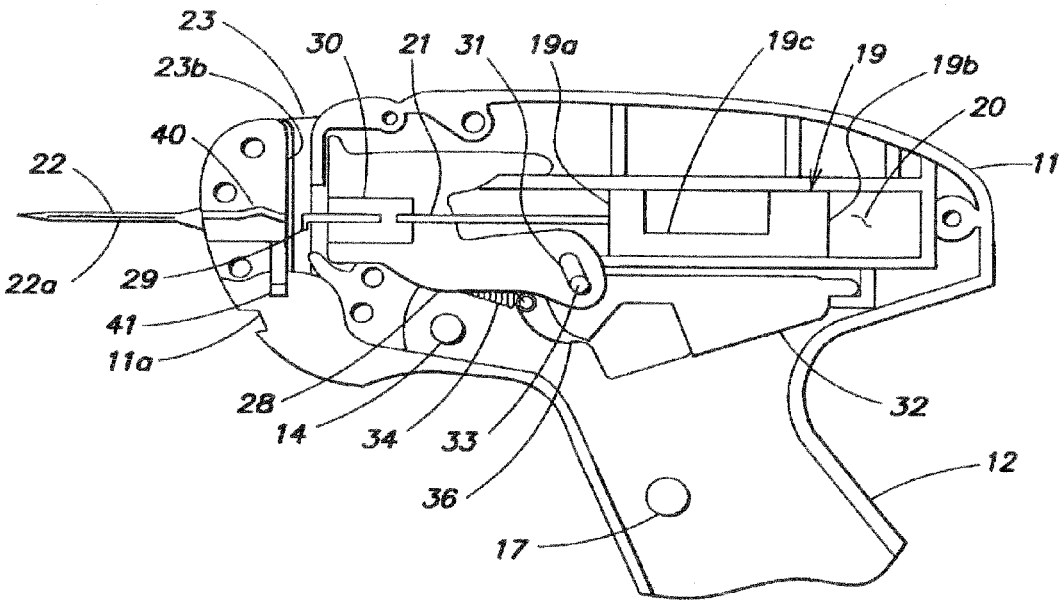
FIG. 6 is another exploded side elevational view with a link arm and a cover plate removed.
Figure 7:
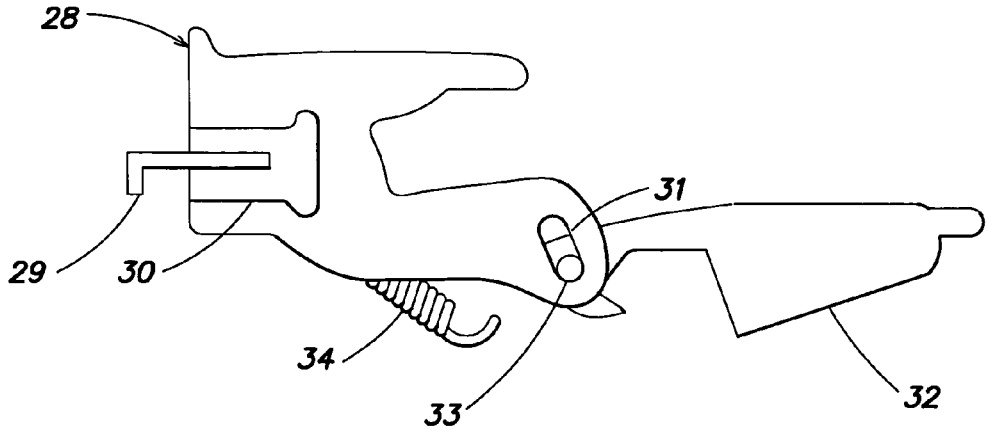
FIG. 7 is a view showing a rotatable member and a supporting member.
Figure 8:
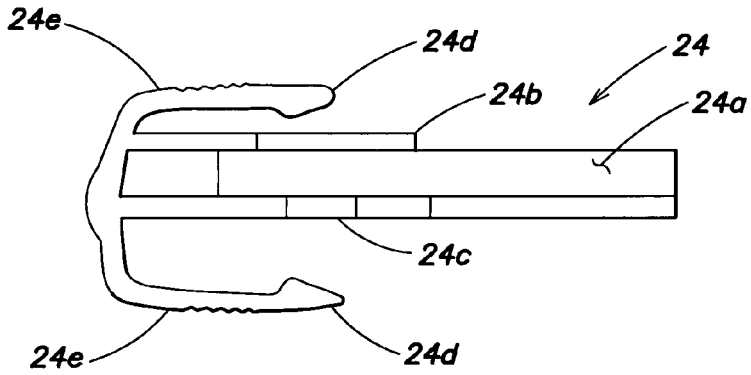
FIG. 8 is a top plan view of a first attachment.
Figure 9:
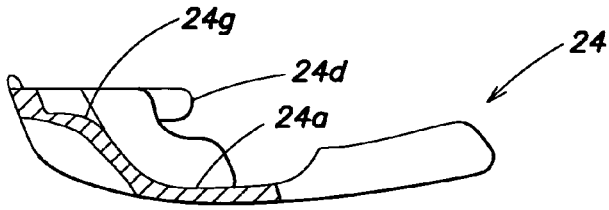
FIG. 9 is a side elevational view, partly in section, of the attachment.
Figure 11:
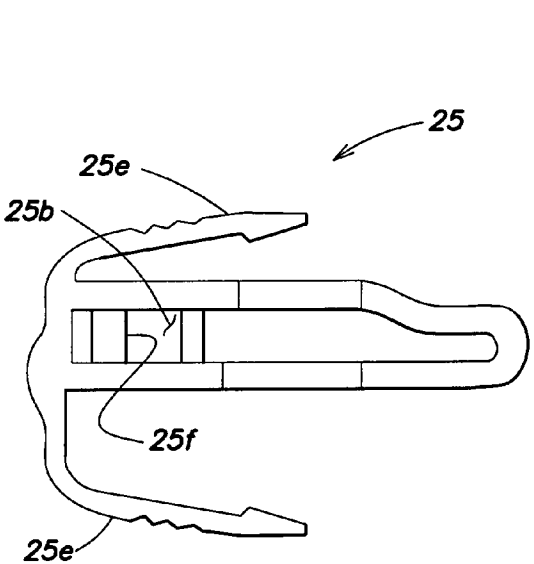
FIG. 11 is a top plan view of a second attachment.
Figure 12:
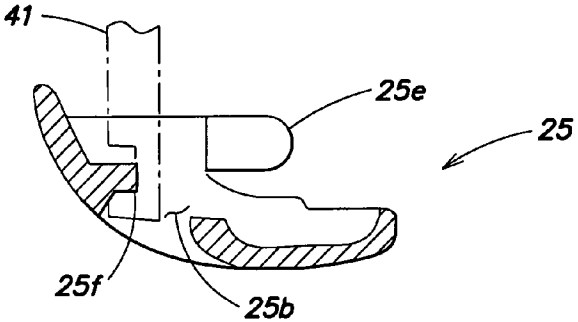
FIG. 12 is a side elevational view, partly in section, of the second attachment.
Figure 10:
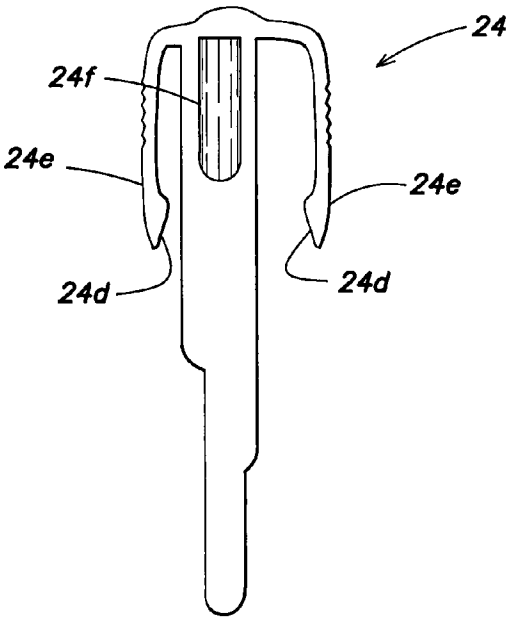
FIG. 10 is a bottom plan view of the attachment.
Figure 14:
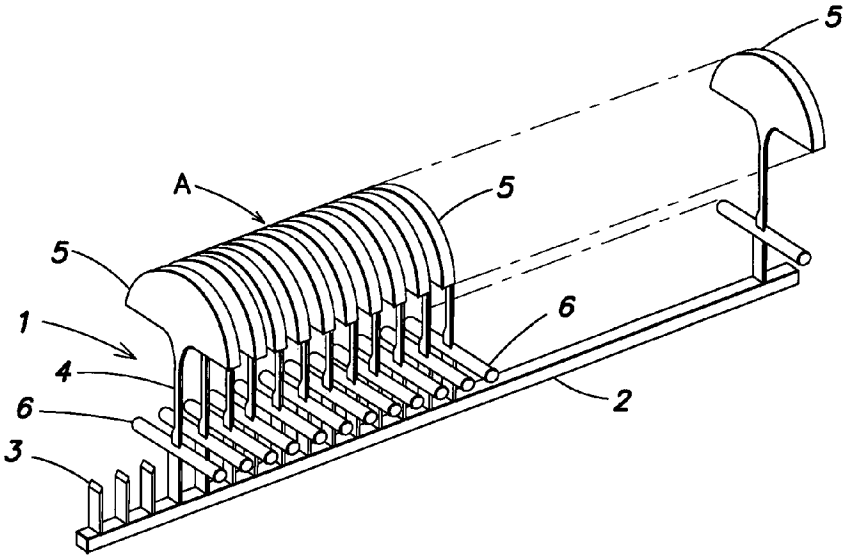
FIG. 14 is a perspective view of a fastener assembly.
Figure 13:
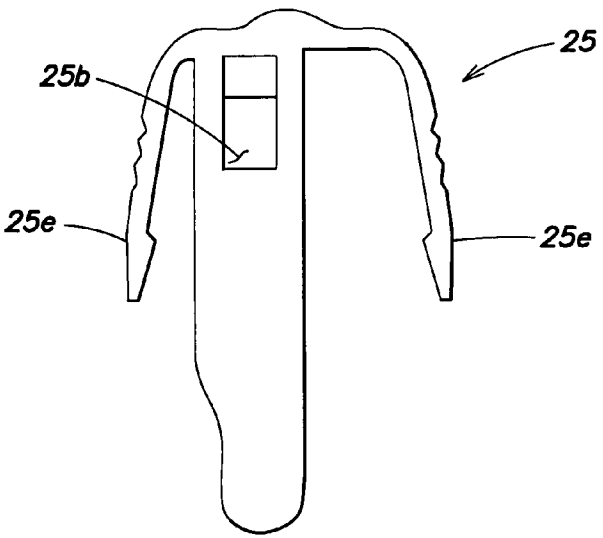
FIG. 13 is a bottom plan view of the second attachment.
Figure 15:
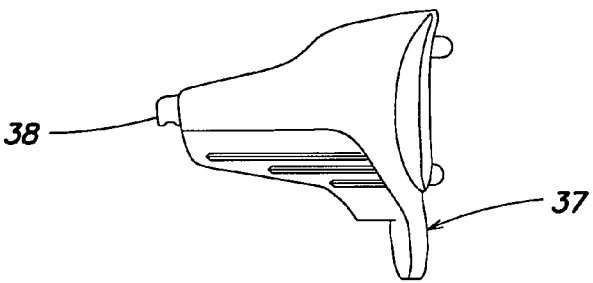
FIG. 15 is a side elevational view of a needle cap.
Figure 16:
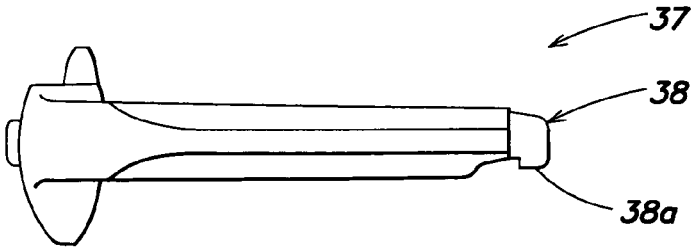
FIG. 16 is a top plan view of a different needle cap.
Figure 17:
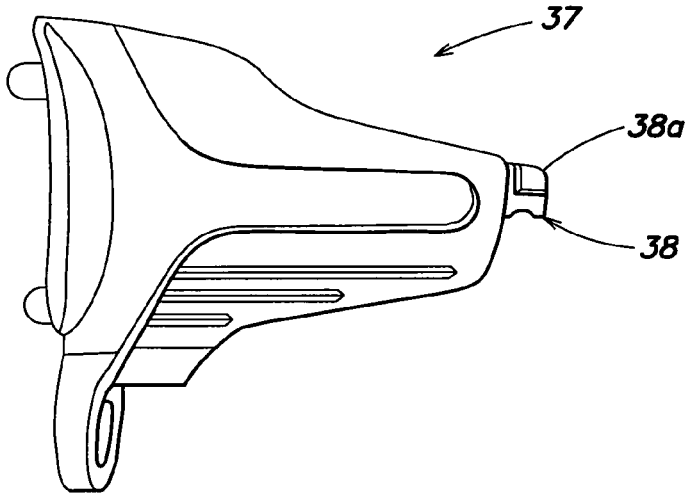
FIG. 17 is a side elevational view of the needle cap shown in FIG. 16.
Figure 18:
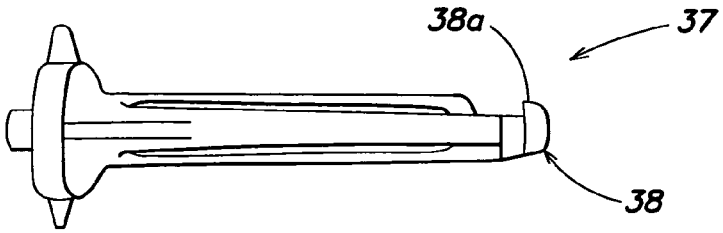
FIG. 18 is a bottom plan view thereof.
Figure 20:
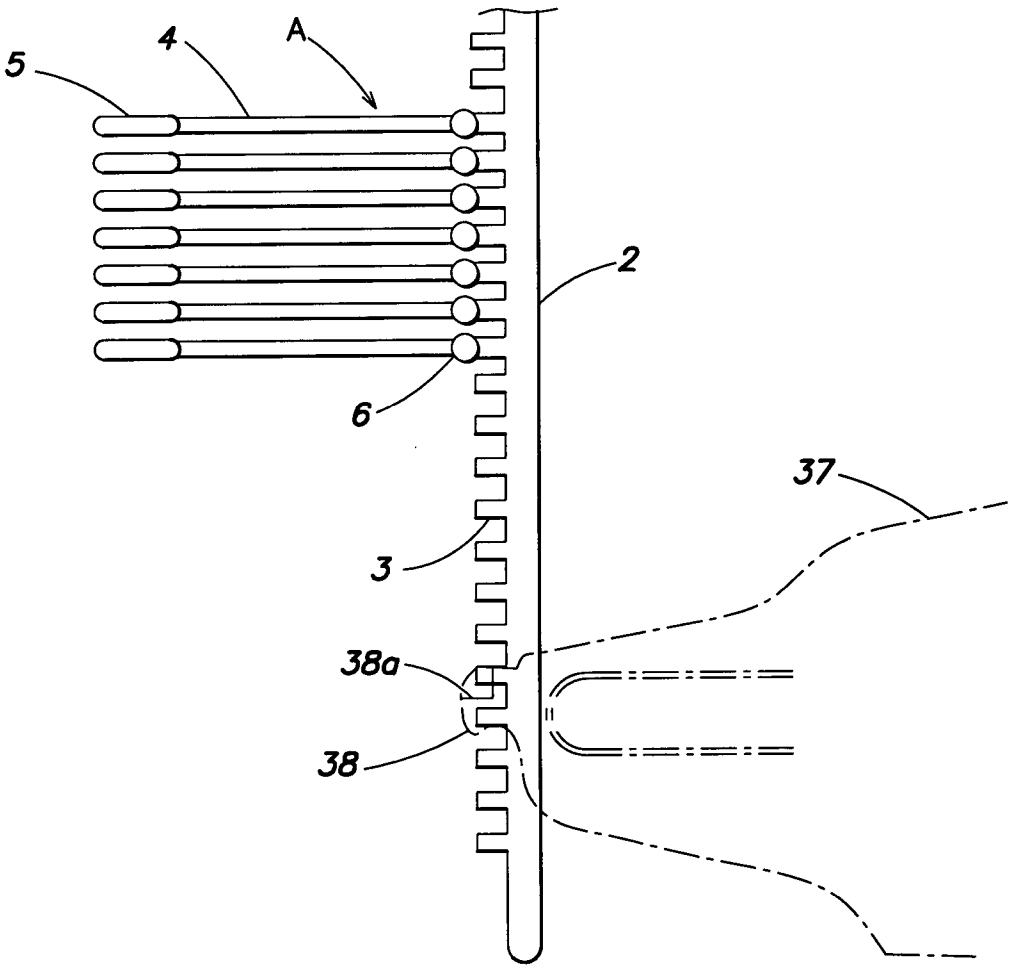
FIG. 20 is a view showing its use.
Figure 19:
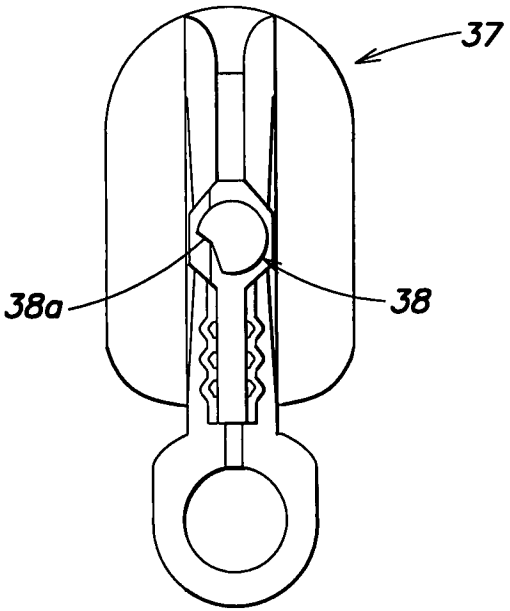
FIG. 19 is a front elevational view thereof.
Figure 21:
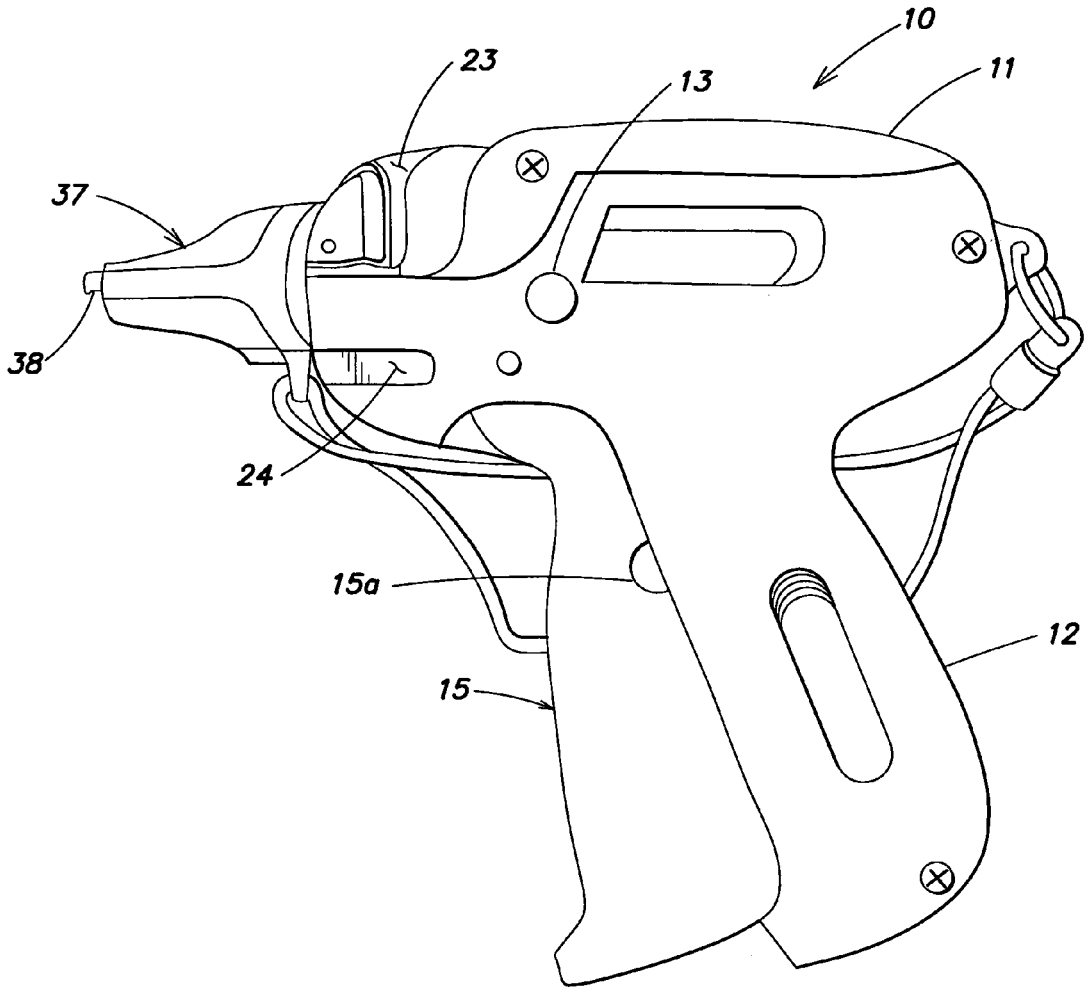
FIG. 21 is a side elevational view showing the needle cap attached to the device.

The preferred embodiment of the invention will now be described with reference to the drawings, in which FIG. 1A is a left side elevational view of a device for attaching fasteners which embodies the present invention, FIG. 1B is an enlarged sectional view of a part of FIG. 1A, FIG. 1C is a longitudinal view of the part shown in FIG. 1B, FIG. 2 is a right side elevational view of the device, FIG. 3 is an exploded side elevational view showing its construction, FIG. 4 is a top plan view of the device, FIG. 5 is an enlarged perspective view showing a part of its construction, FIG. 6 is another exploded side elevational view with a link arm and a cover plate removed, FIG. 7 is a view showing a rotatable member and a supporting member, FIG. 8 is a top plan view of a first attachment, FIG. 9 is a side elevational view, partly in section, of the attachment, FIG. 10 is a bottom plan view of the attachment, FIG. 11 is a top plan view of a second attachment, FIG. 12 is a side elevational view, partly in section, of the second attachment, FIG. 13 is a bottom plan view of the second attachment, FIG. 14 is a perspective view of a fastener assembly, FIG. 15 is a side elevational view of a needle cap, FIG. 16 is a top plan view of a different needle cap, FIG. 17 is a side elevational view of the needle cap shown in FIG. 16, FIG. 18 is a bottom plan view thereof, FIG. 19 is a front elevational view thereof, FIG. 20 is a view showing its use, and FIG. 21 is a side elevational view showing the needle cap attached to the device.

The device for attaching fasteners is generally shown at 10. The device 10 has a casing 11 formed from a pair of opposite members of a plastic material held together by screws and the casing 11 has a grip 12 to be held to use the device. Rubber pads 13 hold the device 10 against slipping when it is placed on a table, or the like.

A lever 15 has its upper end supported rotatably by a pin 14 in front of the grip 12. The lever 15 has a recess 15*a* formed in the mid-portion of its rear surface to receive a pin supporting a link arm rotatably and has also a protrusion 15*b* formed at its lower and rear end to engage a stopper 12*a* formed at the lower end of the grip 12 to hold the lever 15 in position.

The link arm 16 has a hole formed substantially at its center and the pin 17 formed on the grip 12 extends through that hole to support the link arm 16 rotatably. The link arm 16 is normally urged into its initial position by a coil spring 18. The link arm 16 is rotatable about the pin 17 by the lever 15 pressed against its lower front surface.

A piston 19 has a front portion 19*a* and a rear portion 19*b* joined together by a plate 19*c* and employed for moving the piston forward and backward, respectively, and the link arm 16 has its upper end portion disposed between the front and rear portions 19*a* and 19*b* of the piston 19. The piston 19 is held in a box-shaped guide channel 20 to ensure its forward and backward motion in a straight line.

A driving rod 21 has a rear end fixed to the front surface of the front portion 19*a* of the piston 19. Upon rotation of the link arm 16 by the lever 15, the front portion 19*a* of the piston 19 is pushed forward by the upper end portion of the link arm 16 and the driving rod 21 is moved forward in a straight line with the forward movement of the piston 19.

The driving rod 21 extends into a hollow needle 22 attached to the front end of the device 10. The hollow needle 22 is stuck through an article to attach a fastener thereto and has a slit 22*a* formed along its side to allow the filamentary portion 4 of each fastener 1 to leave the needle when each fastener 1 is attached to the article from a fastener assembly A set in the device 10.

The device 10 has an assembly fitting guide 23 formed near its front end for setting a fastener assembly A from above and having a portion 23*a* for inserting the connecting bar 2 and a slit 23*b* for passing the filamentary portion 4, while the lateral pin 6 is set in a line along the longitudinal axis of the device 10.

A cutter 41 having an L-shaped bent lower end is removably situated at the primary end of a filament passage guide groove 40 allowing the passage of the filamentary portion 4 of each fastener 1 near the front end of the casing 11 along the assembly fitting guide 23 for cutting each individual fastener 1 off the fastener assembly A. The filament passage guide groove 40 has an undulating portion formed to allow the passage of the paddle portion 5 of each fastener 1 and thereby prevent any blocking of the groove.

The casing 11 has a recess 11*a* formed below the assembly fitting guide 23 for holding removably a first or second guide attachment 24 or 25 for guiding the connecting bar 2 in the direction of its ejection. The first guide attachment 24 is used for ejecting the connecting bar 2 sideways and backwardly of the casing 11 and has a curved bottom surface 24*a* and a pair of guide walls 24*b* and 24*c* formed along the edges of the curved bottom surface 24*a*. The guide wall 24*b* terminates midway of the bottom surface, since its guiding effect can be achieved by the inner wall surface of the lever 15 or of the grip 12 as stated below, and the guide wall 24*b* has a rear end contacting the front surface of the lever 15, while the guide wall 24*c* and the curved bottom surface 24*a* extend into the device 10. They extend into the device through a hole 15*c* formed in the front surface of the lever 15 and the hole 15*c* has a rounded inner surface held in sliding contact with the outside of the curved bottom surface 24*a* of the attachment 24 without having any clearance formed therebetween upon the rotation of the lever so that no dust may enter the inside. The guide wall 24*c* has a rounded portion 24*g* formed to position the cutter 41 at its lower end held against it.

The first guide attachment 24 has a pair of clips 24*e* formed at its front end and each terminating in an engaging pawl 24*d* and their elasticity makes it possible to set the attachment in position by a one-touch snap-in operation to hold the casing 11 without the aid of any screw. Each clip 24*e* has a rugged surface providing resistance to slipping at the time of attachment or detachment. The attachment 24 has a concavity 24*f* formed to save its material. If the engaging pawl 24*d* is formed only on one of the clips 24*e* which extends on the outside of the casing 11, the attachment 24 is very easy to detach, since it is sufficient to move the outer clip 24*e* alone.

The casing 11 has an ejection guide groove 26 formed on one side thereof and having a width and a depth diminishing gradually from its front to rear end and the ejection guide groove 26 has a hole 27 formed at its base end and faced by the rear end of the first guide attachment 24. The lever 15 has a hole 15*c* formed at its upper end for receiving the rear end of the first guide attachment 24. The ejection guide groove 26 may have an angular guide taper 39 formed on its bottom surface to ensure outward guiding of the connecting bar.

When the first guide attachment 24 is set in position, the connecting bar 2 remaining after the fasteners 1 have been separated from the assembly A is bent along the curved bottom surface 24*a* of the first guide attachment 24 and has its leading end protrude through the hole 27 and ejected gradually along the contour of the ejection guide groove 26 and away from the casing 11.

The second guide attachment 25 has a pair of clips 25*e* formed at its front end like the first guide attachment 24, can be set in position or removed in the same way and has a hole 25*b* connected with the assembly fitting guide 23 to eject the connecting bar 2 downwardly. If the second guide attachment 25 has a different number of notches on its clips from the first guide attachment 24, it is possible at a glance to discern the guide attachment in use. The second guide attachment 25 has a protrusion 25*f* formed along its hole 25*b* and pressed against the cutter 41 to position it.

Shown at 28 is a feeding (or rotatable) member by which the fastener assembly A set in the assembly fitting guide 23 is fed by a distance equal to the spacing between every two adjoining fasteners 1. The feeding member 28 has a feeding pawl 29 formed from a metal at its front end and having a front end bent downward like a hook. The feeding pawl 29 is formed from a metal plate 30 fixed to the front end of the feeding member 28.

The feeding member 28 has an oval hole 31 formed near its rear end and a supporting member 32 has an engaging pin 33 protruding from its front end and fitted in the hole 31 of the feeding member 28. The supporting member 32 is positioned by an inner rib 36 in the casing 11. The link arm 16 has an angular protrusion 16*a* formed at its front end near the supporting pin 17 and held in sliding contact with the inner rib 36. This mode of supporting produces an improved stroke force.

The feeding member 28 is urged by a coil spring 34 into its initial position in which the feeding pawl 29 stays in the assembly fitting guide 23 after having fed a whole fastener assembly A. The feeding member 28 has an arcuate rear end surface fitted slidably in an arcuate groove 19*d* formed around the front and bottom corner of the front portion 19*a* of the piston 19 so that when its rear end surface is pressed by the piston, the feeding member 28 may be rotated as controlled by the engaging pin 33 and have its front end, or feeding pawl 29 lifted from the assembly fitting guide 23 and held above it to take a standby position for another feeding operation.

Shown at 37 is a needle cap which is fastened to the casing 11 by a strap or the like so as not to be lost, and is put on the hollow needle 22 to prevent any possible accident when it is not in use. The needle cap 37 has a scrape pawl 38 formed at its front end for scraping out any remainder of a connecting bar 2 not ejected from the device 10 or the ejection guide groove 26. The scrape pawl 38 makes it possible to remove easily any remainder of a connecting bar 2 that cannot be picked with fingers, without requiring the casing 11 to be disassembled. The scrape pawl 38 not only has a portion for catching a holding pin 3 to take out any connecting bar 2, but also may have a side pawl 38*a* formed near its front end and projecting laterally therefrom. The side pawl 38*a* can be used to catch the lower end of the cutter 41 and detach it, or catch a holding pin 3 sideways and take out any connecting bar 2 as shown in FIG. 20, and is applicable to any assembly having a wide or narrow pitch between every two adjoining holding pins, in which case it will be convenient to turn the needle cap 37 to some extent.

When the lever 15 is loosened after the device has been started from its standby position and has driven a fastener 1, the link arm 16 is urged by the coil spring 18 to push the rear portion 19*b* of the piston 19 and allow it to restore its initial position and when it has been restored, the feeding member 28 held in the groove 19*d* of the front portion 19*a* of the piston 19 is relieved from its pressure and urged by the coil spring 34 into its initial position, in which its feeding pawl 29 engages a holding pin 3 in the fastener assembly A and feeds the assembly A by one pitch. Owing to its performance as described, the invention does not require any second arm as shown in Related Art Literature 2, but is free from any inconvenience caused by any such second arm interfering with the restoration of the device into its initial position.

Shown at 35 is a metallic cover plate held against the feeding member 28 for protecting it and having a concavity 35*a* of small depth formed to prevent any undesirable movement of the driving rod 21.

Although the device embodying the invention as described above is of the type which is suitable for use by a right-handed person or with a right hand, it will be alternatively possible to form the ejection guide groove 26 on the other side of the casing 11 for a left-handed person, or form one ejection guide groove 26 on each side of the casing 11 to enable a selective use of the guide attachments for the ejection of any connecting bar 2 on either side of the device as desired.

What is claimed is:

1. A device for attaching fasteners comprising:

a casing having a grip;

a lever supported by the casing rotatably about an upper end of the lever and urged forward;

a link arm actuated by the rotation of the lever;

a piston engaged slidably by an upper end of the link arm;

a driving rod slidable with the piston;

a hollow needle situated at a leading end of the driving rod and having a slit; and an assembly fitting guide that is formed behind the hollow needle and that is adapted to fit an assembly of plastic fasteners;

wherein a removable guide attachment, which is changeable with another removable guide attachment, is removably held below the assembly fitting guide and is adapted to guide a connecting bar in the assembly in an ejection direction;

wherein the casing has an ejection guide groove that is formed on one side thereof and that is adapted to guide ejection of the connecting bar of the assembly, wherein the removable guide attachment has a curved surface directed toward the ejection guide groove, wherein the casing has a first hole connected with the ejection guide groove, and wherein the lever has a second hole so that the connecting bar is passable through the first and second holes; and wherein the second hole formed in the lever is adapted to have a part of the removable guide attachment inserted therein so that a rounded inner surface of the second hole is brought into sliding contact with an outer surface of the inserted part of the removable guide attachment upon the rotation of the lever such that any clearance is prevented from occurring therebetween.

2. The device for attaching fasteners as set forth in claim 1, wherein the ejection guide groove is gradually reduced in depth and width to allow the ejection of the connecting bar so that a leading end thereof moves away from the casing.

3. The device for attaching fasteners as set forth in claim 1, wherein said another removable guide attachment has a hole formed at a bottom thereof to allow downward ejection of the connecting bar along the assembly fitting guide.

4. The device for attaching fasteners as set forth in claim 1, wherein the ejection guide groove has an auxiliary taper formed on an inner bottom wall surface thereof having an angle or chevron section.

5. The device for attaching fasteners as set forth in claim 1, wherein each of the removable guide attachments has elastic clips formed as integral parts thereof to set the guide attachment in position, and wherein at least one of the elastic clips which is positioned outside the casing terminates in an engaging pawl to produce a retaining action to hold the guide attachment against the casing.

6. The device for attaching fasteners as set forth in claim 1, further comprising a removable needle cap which is placeable on the hollow needle when the device is out of use, the needle cap having a scrape pawl formed at a front end thereof for scraping off any remaining connecting bar.

7. The device for attaching fasteners as set forth in claim 1, wherein the casing has a filament passage guide slit formed to connect the assembly fitting guide and the slit of the hollow needle and having an undulating portion to allow paddles of the plastic fasteners to pass therethrough.

* * * * *